United States Patent [19]

Whitehouse, Jr.

[11] 4,194,733

[45] Mar. 25, 1980

[54] WATER SLIDE SYSTEM

[76] Inventor: Ben Whitehouse, Jr., P.O. Box 2684, Titusville, Fla. 32780

[21] Appl. No.: 922,056

[22] Filed: Jul. 5, 1978

[51] Int. Cl.[2] ..... A63G 21/18

[52] U.S. Cl. ..... 272/56.5 R; 104/70; 405/119

[58] Field of Search ..... 272/56.5 R, 56.5 SS, 272/1 B, 32; 104/69, 70, 72, 73, 56, 57, 63, 64, 67, 70, 72, 73, 134, 135, 136, 59, 86; 193/2 R, 2 A, 25 E, 12, 13, 27, 28, 33, 38; 182/48; 405/119, 121, 126, 120, 80, 87, 88, 94, 95; 138/106, 107, 117; 46/1 K, 43; 4/172.17; 137/236; 210/169, 170

[56] References Cited

U.S. PATENT DOCUMENTS

| | | | |
|---|---|---|---|
| 419,860 | 1/1890 | Libbey | 104/73 |
| 536,441 | 3/1895 | Morris | 104/70 |
| 689,114 | 12/1901 | Pape | 104/73 |
| 824,436 | 6/1906 | Pester | 104/70 |
| 861,919 | 7/1907 | Thompson | 272/56.5 R |
| 925,053 | 6/1909 | Sturgis | 405/119 X |
| 1,417,594 | 5/1922 | Coe | 272/56.5 R X |
| 1,763,976 | 6/1930 | Lippincott | 104/73 |
| 2,868,137 | 1/1959 | James | 104/73 |
| 4,145,042 | 3/1979 | Becker et al. | 272/56.5 R |
| 4,149,710 | 4/1979 | Rouchard | 405/121 |

FOREIGN PATENT DOCUMENTS

| | | | |
|---|---|---|---|
| 12884 | of 1889 | United Kingdom | 104/70 |
| 25010 | of 1902 | United Kingdom | 104/70 |

*Primary Examiner*—Richard C. Pinkham
*Assistant Examiner*—Arnold W. Kramer
*Attorney, Agent, or Firm*—Duckworth, Hobby, Allen & Pettis

[57] ABSTRACT

A water slide apparatus having a helical slide tube extending from an elevated platform to a pool of water. The water slide has a starting gate having two starting positions mounted adjacent the elevated platform and connected to the water slide tube, and each having a water line opening into the back thereof. Water is supplied by a pump from a pool of water at the base and is directed from a first starting position to a second starting position, in such a manner that the water is never shut off.

10 Claims, 7 Drawing Figures

FIG. 2
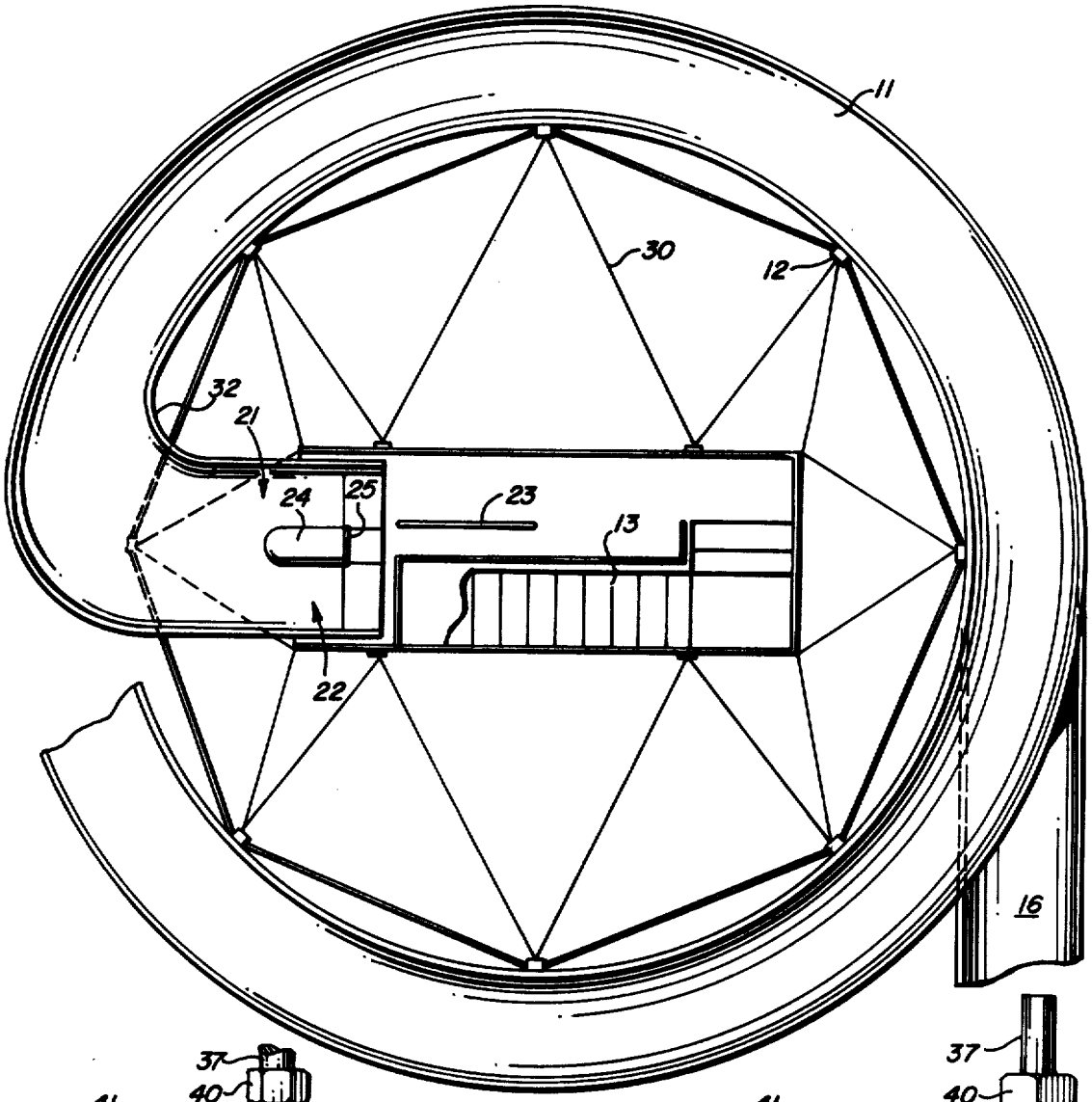
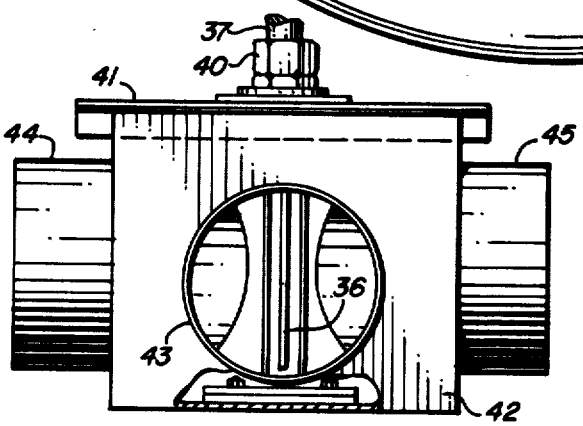
FIG. 6
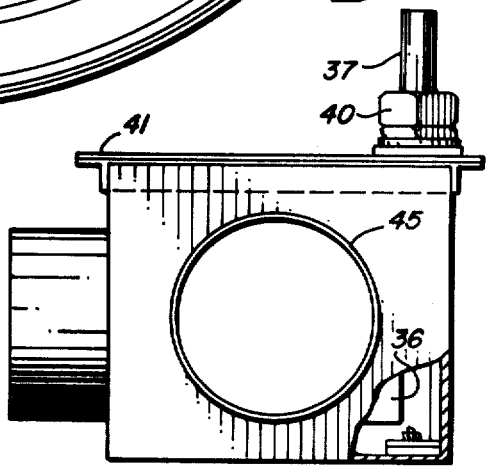
FIG. 7

WATER SLIDE SYSTEM

BACKGROUND OF THE INVENTION

The present invention relates to water slides, and especially to a helical water slide for a slider from an elevated platform into a plunge pool .

In the past, a great variety of water slides have been provided for entering swimming pools. The typical slide has steps leading to the top of a straight or curved sliding board, so that the user can slide into a swimming pool. Larger slides have also been built, and in some of the new water attractions, a large hill has been built having a slide circling the hill into a pool of water. Larger sildes typically have a source of running water running on the slide so that the slider slips with the water, and may include pads for the user to sit on to slide along the surface.

The present invention relates to a commercial type slide, which may be, for instance, five stories high, and having a central steel structure, and stairs or an elevator to an elevated platform where a slider is launched down a spiraling slide surface or tube at relatively high speed and into a plunge pool. A deceleration run may be provided to slow the rider down before he hits the pool.

SUMMARY OF THE INVENTION

A water slide system has a water slide surface extending from an elevated platform to a pool of water. A first starting position is located adjacent the elevated platform and connected to the water slide surface for directing slider onto the water slide surface and has a water line opening onto the starting position to drive the slider onto the slide surface. A second starting position may be identical to the first starting position and mounted adjacent the elevated platform and connected to the water slide surface, and may be located near the first starting position and also has a water line opening. A valving system allows the water to be directed from one starting position to the other to launch one slider in one starting position while the other one is being loaded, but without shutting off the flow of water. The continuous flow of water prevents back pressure on the pump and provides a continuous flow of water on the slide surface. A small leakage prevents either starting position from drying out.

BRIEF DESCRIPTION OF THE DRAWINGS

Other objects, features and advantages of the present invention will be apparent from the written description and the drawings, in which :

FIG. 2 is a top elevation of the water slide of Fig. 1;

FIG. 6 is a side elevation of the valve of FIG. 5; and

FIG. 7 is a second side elevation of the valve of FIGS. 5 and 6.

DESCRIPTION OF THE PREFERRED EMBODIMENT

Figure 1:
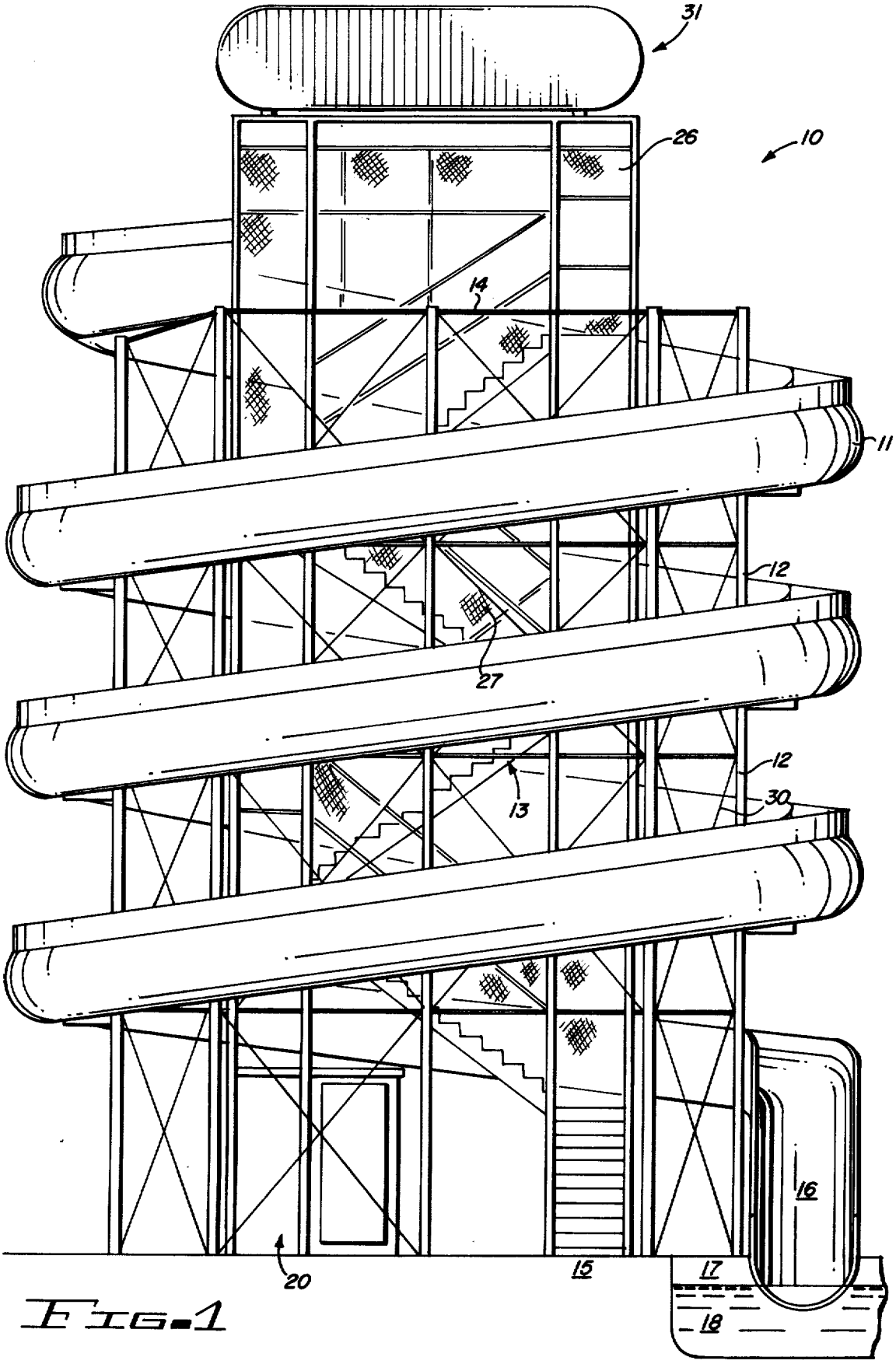
FIG. 1 is an elevational view of a water slide system in accordance with the present invention.
Figure 3:
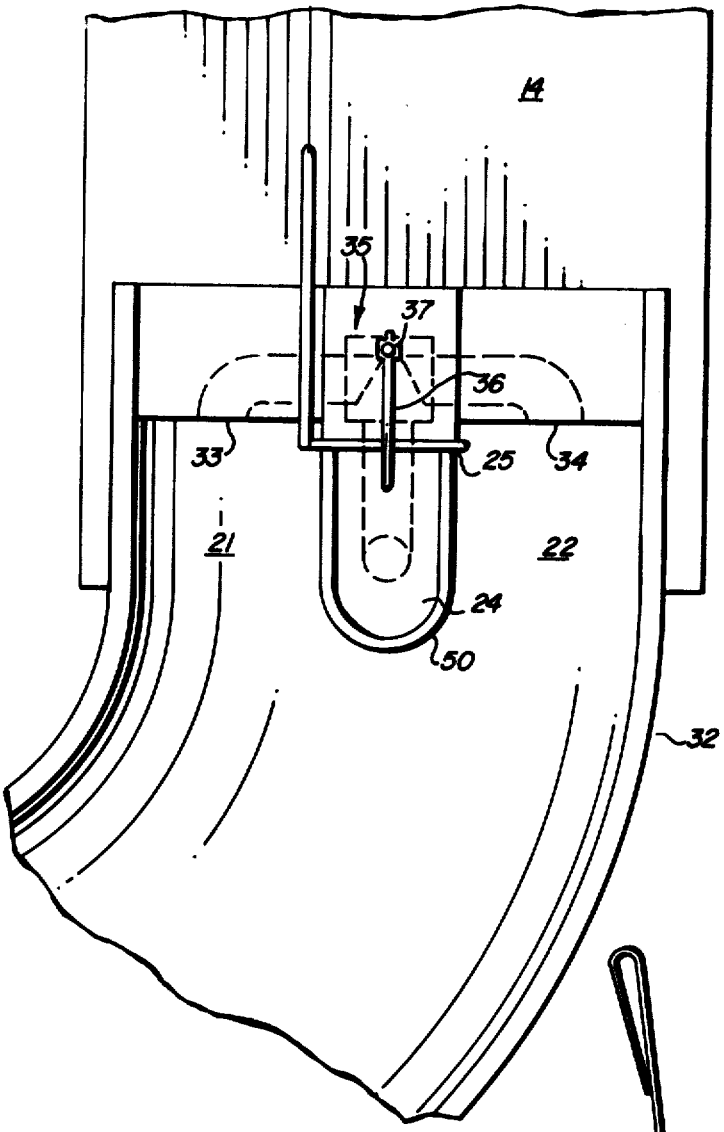
FIG. 3 is a top elevation of a pair of starting positions for a slide in accordance with FIGS. 1 and 2.
Figure 4:
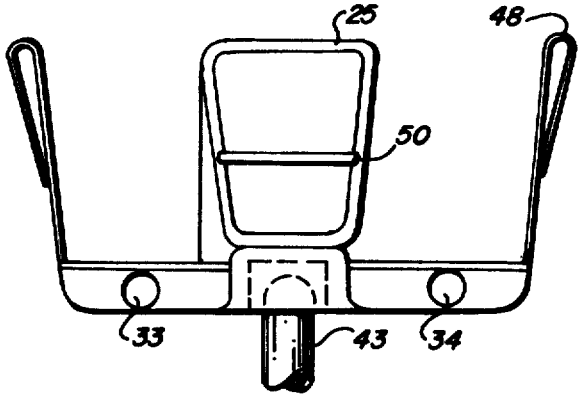
FIG. 4 is a front elevation of the starting positions of FIG. 3.

Referring to the drawings, and especially to FIGS. 1 and 2, a water slide system 10 is shown having a water slide surface or tube 11 helically wrapped around a steel frame 12 having steel columns and interconnected supports 30 and a stairway 13 leading to a platform 14 from the ground level 15. The slide tube 11 wraps around the framework 12 and enters into a deceleration run 16 and into a plunge pool 17 filled with water 18. A pump house 20 is located on ground level 15 and pumps water from the pool 17 up to the platform 14 level where starting positions 21 and 22 are located. A rider on the slide starts at ground level 15, proceeds up the steps 13 to the platform 14 and stands on one side or the other of a dividing rail 23 and enters that start position 21 or 22 where an operator positioned on a platform 24 alternately operates the starting positions 21 or 22 to launch the slider onto the sliding surface 11. A rail 25 is positioned to separate the operator on the platform 24. The platform of the water slide has a chain link fence 26 to prevent accidents, while the steps 13 have a railing and fence 27 and steel columns 12 are interconnected with structural bars 30, and an advertising sign or display 31 may be mounted on top of the steel frame 12 above the platform 14 if desired.

Figure 5:
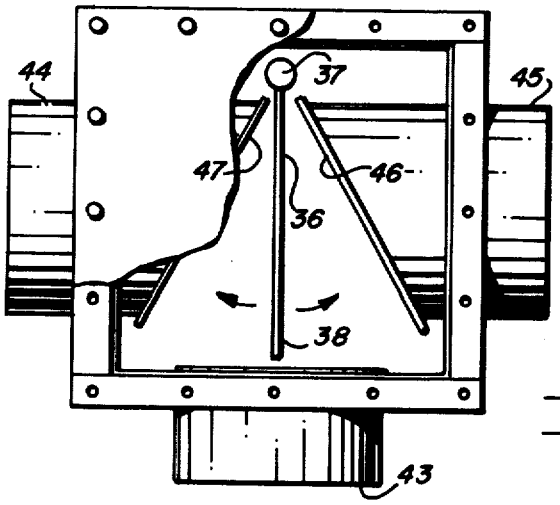
FIG. 5 is a fragmentary elevation of a water control valve for the starting gates in FIGS. 3 and 4.

The operation of the starting gates is more clearly illustrated in connecton with FIGS. 3 through 7 which may have their bases made of fiberglass similar to the sliding surface 11 and can be curved by curve 32 into the helical slide 11. Starting position 21 has a water line opening 33 while starting position 22 has a water line opening 34. Water line opening 33 is connected to one side of a valve 35, while water line 34 is connected to the opposite side of the valve 35. A handle 36 allows the operator standing on the platform 24 behind the rail 25 to operate the handle 36 to rotate a valve shaft 37. The shaft 37 is connected to the valve element 38 which may be an aluminum or steel plate valve element which is rotated by the shaft 37 passing through a shaft seal 40 in the valve top 41. The valve also has a casing 42, a central inlet pipe 43, an outlet 44 and an outlet 45. Inside the valve, as illustrated in FIG. 5, the pipe 45 has a valve seat 46 while the outlet 44 has a valve seat 47. In operation, moving the shaft 37 and valve element 38 against the valve seat 47 will seal the output in the line 44 except that the system is designed to have a relatively sloppy fit so that some water will pass into the pipe 44, even when the valve is directing the water through the pipe 45, so as not to allow the starting position 21 seat to dry out. As the valve element 38 is moved from the seat 47 to the seat 46, the water entering the input 43 is continuously flowing either into output 44 or output 45, or both, since in an intermediate position the water is flowing out of both pipes and even when one is closed, some leakage is allowed for. This prevents the cut-off of flow as provided in most valve elements, which must build up a back pressure on the pump and subsequently damage the pump. Thus, the valving element advantageously, allows some water to flow out of both openings onto both starting postions 21 and 22, while directing most of the water to only one opening but never shutting off the water as long as the pump is running. The sudden surge of water out of the pipes 44 or 45 to the openings 33 and 34 will give a sudden lunge to the movement of the rider on the starting position and will allow one rider to be started while another rider is getting into position. The operator shifts from one rider to the other rider, thereby rapidly launching riders down a single slide and avoiding the wasted time resulting from a single starting position. The starting positions may be made with rails 48 and rails 50 to allow a person to ease into a starting position, where they would normally sit on a pad of flexible cloth to slide on.

It should be clear at this point that a large scale water slide system has been provided for rapidly launching individual sliders in which the sliding surface or track is made of fiberglass which can be helically formed around a steel framework having a flip-flop type valve providing for continuous flow of water when the system is in operation. The valve may be made of any material desired, such as fiberglass or metal having an aluminum alloy valve element 38 which is in the nature of a square or rectangular plate attached to a steel shaft. However, the present invention is not to be considered limited to the forms shown, which are to be considered illustrative rather than restrictive.

I claim:

1. A water slide system comprising in combination:

a water slide surface extending from an elevated platform to a pool of water;

a first starting position located adjacent said elevated platform and connected to said water slide surface for directing a slider onto said water slide surface, said first starting position having a water line opening thereonto;

a second starting position located adjacent said elevated platform and connected to said water slide surface for directing a slider onto said water slide surface, said second starting position having a water line opening thereonto; and means for directing water from one starting position water line opening to the other starting position water line opening whereby one slider can be launched in one starting position while another slider is getting into position in the other starting position.

2. A water slide in accordance with claim 1, in which said means for directing water from one starting position water line to the other starting position water line includes a valve having a valve element moving from one valve seat to another for directing the flow from one water line to another without stopping the flow of water through the valve.

3. A water slide in accordance with claim 2, in which said valve element includes a metal plate attached to a shaft rotatable between first and second positions, the first position substantially closing the water into the water line of said first starting position and said second position opening the flow of water into said first starting position water line and substantially closing the water line of said second starting position.

4. The water slide system in accordance with claim 3, in which said valve has a water line connected from a pump which is connected to said pool of water at the end of said water slide surface.

5. The water slide system in accordance with claim 4, in which said first starting position and said second starting position have rails for assisting a slider for getting into position.

6. The water slide in accordance with claim 5, in which said valve shaft extends from a valve casing and has an arm thereon and is actuated by an operator on a platform positioned between said first and second starting positions.

7. The water slide in accordance with claim 6, in which said water slide surface is a formed fiberglass surface having an arcuate cross-section and following a helical track from said platform to said pool of water.

8. The water slide system in accordance with claim 2, in which said first starting position water line opening is located in the back of the platform directed at the back of the slider sitting in a first starting position.

9. The water slide system in accordance with claim 3, in which said valve seats are formed of a flanged surface without seals.

10. A water slide in accordance with claim 7, in which said water slide system has a steel framework having steel columns and reinforcing steel rods supporting said water slide surface and elevated platform and has a stairway leading from the ground surface to said platform, said platform being surrounded by a safety fence.

* * * * *